US005127390A

United States Patent [19]

Paulson

[11] Patent Number: 5,127,390

[45] Date of Patent: Jul. 7, 1992

[54] WHEEL FOR BALL THROWING MACHINE

[76] Inventor: Kerry K. Paulson, 27700 SW. Heater Rd., Sherwood, Oreg. 97140

[21] Appl. No.: 611,605

[22] Filed: Nov. 13, 1990

[51] Int. Cl.[5] ..... F41B 15/00

[52] U.S. Cl. ..... 124/80; 124/1; 124/6; 124/78; 152/323; 152/379.3; 152/396

[58] Field of Search ..... 124/1, 4, 6, 78, 80, 124/81; 152/323, 375, 379.3, 380, 396

[56] References Cited

U.S. PATENT DOCUMENTS

| | | | |
|---|---|---|---|
| 1,759,238 | 5/1930 | Merle | 152/323 X |
| 1,882,498 | 10/1932 | Jarvis | 152/323 |
| 2,087,365 | 7/1937 | Weisemann | 152/323 X |
| 2,277,604 | 3/1942 | Orr | 152/323 X |
| 3,020,091 | 2/1962 | Solomon | 152/375 X |
| 3,533,662 | 10/1970 | Richards et al. | 152/379.3 X |
| 3,724,437 | 4/1973 | Halstead | 124/78 |
| 4,026,261 | 5/1977 | Paulson et al. | 124/78 |
| 4,080,950 | 3/1978 | Paulson et al. | 124/1 |
| 4,153,303 | 5/1979 | Tanner | 152/379.3 X |
| 4,193,591 | 3/1980 | Paulson | 124/78 |
| 4,197,827 | 4/1980 | Smith | 124/78 |
| 4,561,414 | 12/1985 | Nozato | 124/78 |
| 4,590,980 | 5/1986 | Kuhn | 152/323 |
| 4,712,534 | 12/1987 | Nozato | 124/78 |
| 4,760,835 | 8/1988 | Paulson et al. | 124/78 |
| 4,922,885 | 5/1990 | Iwabuchi et al. | 124/78 |

*Primary Examiner*—Randolph A. Reese
*Assistant Examiner*—John A. Ricci
*Attorney, Agent, or Firm*—Olson & Olson

[57] ABSTRACT

A wheel for a ball throwing machine includes a tire-mounting wheel formed of two lateral halves of spun metal each having a central portion and an angularly extending rim portion, the central portions of the two halves being arranged in abutting relation with the rim portions diverging outwardly. A resilient solid polyurethane tire is molded integrally to the outer surfaces of the diverging rim portions, securing the two halves together. The tire is molded to a resilient hardness ranging between about 25A and 75A Durometer, preferably about 40A Durometer. Circumferentially spaced registering holes in the central portions of the two wheel halves removably receive bolts by which to secure the wheel to the hub of a power driven rotary shaft of a ball throwing machine.

5 Claims, 1 Drawing Sheet

WHEEL FOR BALL THROWING MACHINE

BACKGROUND OF THE INVENTION

This invention relates to ball throwing machines, and more particularly to a ball-gripping wheel for such machines.

Ball throwing machines have been provided heretofore in a wide variety of structural forms. One of such forms employs one or a pair of rotary wheels by which a ball is projected. Typical of this form of ball throwing machine are those disclosed in U.S. Pat. Nos. 4,026,261; 4,080,950; 4,193,591; and 4,760,835.

The prior art ball throwing machines of the type disclosed in the above identified patents utilize rotary wheels which include a pneumatic tire mounted on a wheel which is supported on a rotary shaft driven at high speed by an electric motor.

Rotary wheels of the pneumatic tire type are characterized by a number of disadvantages and limitations. Principal among these are the requirement to maintain proper inflation pressure in order to insure consistent ball-gripping action, the frequency of wheel balancing to prevent wheel wobble and consequent irratic ball throwing, and the excessive cost of such wheels and their maintenance.

SUMMARY OF THE INVENTION

The ball throwing wheel of this invention includes a metal wheel configured with perfect balance and supporting thereon a tire of polyurethane resin or other suitable material having a Durometer hardness of between 25A and 75A, preferably about 40A.

The principal objective of this invention is to provide a ball throwing wheel which overcomes the aforementioned disadvantages and limitations of ball throwing wheels of the prior art.

Another objective of this invention is the provision of a ball throwing wheel of the class described which is produced in precisely balanced condition and is retained in that condition throughout a long operating life without significant maintenance.

A further objective of this invention is the provision of a ball throwing wheel of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 2:
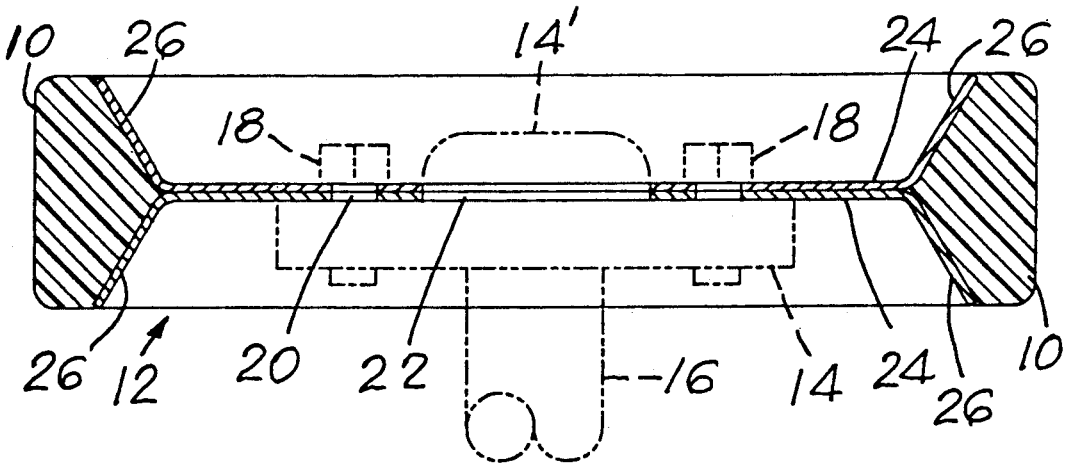
FIG. 2 is a transverse sectional view taken on the line 2—2 in FIG. 1.
Figure 1:
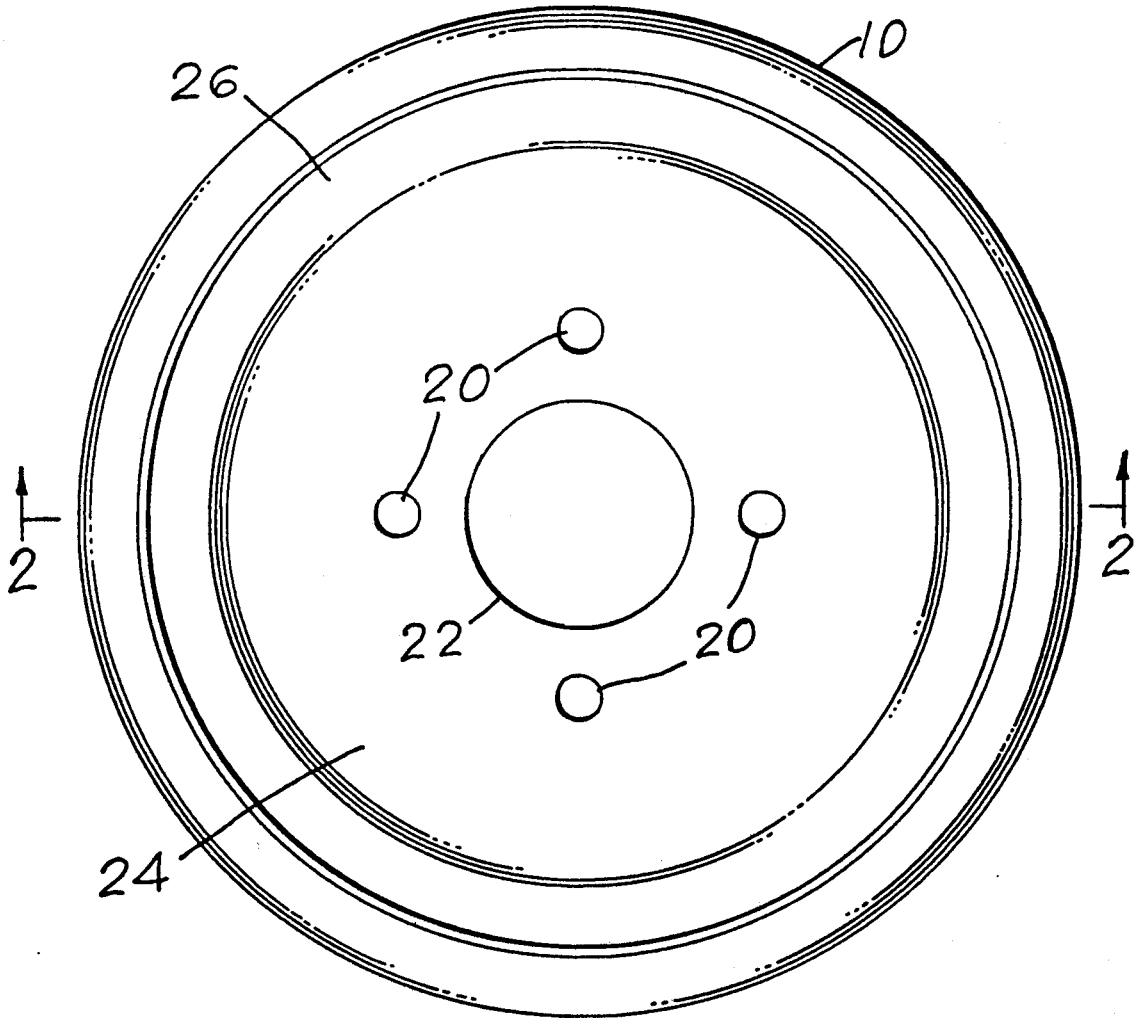
FIG. 1 is a plan view of a ball throwing wheel embodying the features of this invention.

As illustrated in the drawings, the wheel in basic form includes a resilient tire 10 mounted upon a supporting wheel 12 which is configured for detachable mounting on the hub 14 of a rotary shaft 16 of a ball throwing machine, as by bolts 18 extending through circumferentially spaced bolt holes 20. A central opening 22 in the wheel is provided to receive the projecting central portion 14' of the hub.

In accordance with this invention, the wheel 12 preferably is formed of two lateral halves of substantially identical dish configuration. Each half includes a central flat portion 24 and a circumferential rim portion 26. The rim portion extends angularly outward from the central portion and forms with the latter an included obtuse angle of about 120 degrees.

In the preferred embodiment illustrated, the wheel halves are formed of aluminum or other suitable metal by the well known technique of metal spinning. As distinguished from metal stamping and casting, metal spinning produces wheel halves which, when assembled, form the wheel 12 which is in perfect balance. Thus, the wheel requires no initial or subsequent periodic balancing.

The two lateral halves of the wheel are arranged with their central portions 24 in abutment and with the rim portions 26 diverging outwardly. The bolt holes 20 and central opening 22 in the central wheel portions are aligned in registry and the wheel halves then are secured together.

In accordance with the preferred embodiment of this invention, the wheel halves are secured together by being bonded integrally with the tire 10. This is accomplished by placing the aligned wheel halves in the mold of a polyurethane injection mold and then injecting polyurethane resin into the mold to form the tire 10. The tire thus is bonded securely to the outer surfaces of the rim portions 26, thereby contemporaneously securing the wheel halves together.

In accordance with this invention, the tire 10 is formed of polyurethane resin or other suitable material capable of providing a resilience with the range of about 25A to 27A Durometer, preferably about 40A Durometer. Resilience of less than about 25A Durometer produces a tire which is too soft to maintain symmetry during high speed rotation and proper gripping of a ball to be thrown. Above about 75A Durometer, the tire is too firm to provide adequate gripping of a ball to be thrown. It has been found that a resilience of about 40A Durometer provides the wheel with optimum characteristics of wheel balance and ball gripping action.

The wheel of this invention, as described hereinbefore, is of simplified construction for economical manufacture. It maintains perfect balance over its long operating life and thus functions without wobble to throw balls at high speed with high and reproducible accuracy.

It will be apparent to those skilled in the art that various changes may be made in the size, shape, type, number and arrangement of parts described hereinbefore, without departing from the spirit of this invention and the scope of the appended claims.

I claim:

1. A wheel for a ball throwing machine of the type in which at least one rotary wheel frictionally engages a ball to project the ball therefrom, the wheel comprising:

a) a tire-mounting wheel having a central portion configured for mounting on a power driven rotary shaft and a circumferential rim portion configured for mounting a ball-gripping tire, the tire-mounting wheel including two lateral halves each having a central portion and a rim portion, the two halves being disposed together with the central portions in abutment and the rim portions diverging radially outwardly from each other, and b) a solid tire of synthetic elastomeric material bonded securely to the diverging rim portions and securing the two lateral wheel halves together against separation.

2. The wheel of claim 1 wherein the tire is molded directly onto and bonded to the diverging rim portions.

3. The wheel of claim 2 wherein the tire is molded of polyurethane resin.

4. The wheel of claim 3 wherein the molded polyurethane resin tire has a resilience ranging between about 25A and 75A Durometer.

5. The method of making a wheel for a ball throwing machine of the type in which at least one rotary wheel frictionally engages a ball to project the ball therefrom, the method comprising:

a) providing two lateral wheel halves each having a central portion and a rim portion projecting angularly outward from the central portion, b) disposing the two halves together with the central portions in abutment and the rim portions diverging radially outwardly from each other, and c) securely bonding to the diverging rim portions a solid tire of synthetic elastomeric material, thereby securing the two lateral wheel halves together against separation.

* * * * *